US005141615A

United States Patent [19]

Saeki et al.

[11] Patent Number: 5,141,615

[45] Date of Patent: Aug. 25, 1992

[54] ALUMINUM ELECTROPLATING APPARATUS

[75] Inventors: Isao Saeki; Setsuko Takahashi, both of Chiba; Masayoshi Tatano; Asakawa Kiyoshi, both of Osaka; Yutake Sugiura, Hyogo; Jyun Mori; Tadaaki Narada, both of Osaka, all of Japan

[73] Assignees: Nisshin Steel Co., Ltd.; Mitsubishi Petrochemical Co., Ltd., both of Tokyo; C. Uyemura & Co., Ltd., Osaka, all of Japan

[21] Appl. No.: 719,226

[22] Filed: Jun. 21, 1991

[30] Foreign Application Priority Data

| | | | |
|---|---|---|---|
| Jul. 16, 1990 | [JP] | Japan | 2-188503 |
| Jul. 16, 1990 | [JP] | Japan | 2-188504 |
| Jul. 16, 1990 | [JP] | Japan | 2-188505 |
| Jul. 19, 1990 | [JP] | Japan | 2-192145 |

[51] Int. Cl.[5] ..... C25D 17/06

[52] U.S. Cl. ..... 204/198; 204/225

[58] Field of Search ..... 204/198, 225

[56] References Cited

FOREIGN PATENT DOCUMENTS

| | | |
|---|---|---|
| 63-26399 | 2/1988 | Japan . |
| 64-87799 | 3/1989 | Japan . |
| 1-272788 | 10/1989 | Japan . |
| 1-272790 | 10/1989 | Japan . |

*Primary Examiner*—T. M. Tufariello

*Attorney, Agent, or Firm*—Nikaido, Marmelstein, Murray & Oram

[57] ABSTRACT

An entrance chamber is provided adjacent a plating chamber at a substantially same level as the plating chamber. A carrier is provided for supporting a jig for hanging a workpiece and for conveying the jig between the entrance chamber and the plating chamber. A conveying device is provided in the plating chamber for conveying the jig between the carrier and a plating tank in the plating chamber for performing the plating of the workpiece.

11 Claims, 13 Drawing Sheets

ALUMINUM ELECTROPLATING APPARATUS

BACKGROUND OF THE INVENTION

The present invention relates to an apparatus for electroplating metallic workpieces such as steel plates with aluminum in a sealed chamber.

The oxide film formed on the surface of aluminum has excellent corrosion resistance. Therefore, aluminum is used for obtaining products having good corrosion resistance and durability.

In general, the aluminum coating is formed on the object by the hot dipping. In the hot dipping method, aluminum is heated at a temperature higher than 600° C. to form a plating bath. Consequently, a large heat source is necessary for providing the plating bath, and other problems arise for performing the aluminum coating.

In recent years, an electroplating has been proposed where the electrolyte is maintained below 200° C. for the aluminum coating. (see Japanese Patent Application Laid-Opens 63-26399, 64-87799, 1-272788 and 1-272790).

The electrolyte solution used in the aluminum electroplating easily reacts with oxygen in the air and water to be deteriorated. Therefore, the electrolyte solution is maintained in a sealed chamber as described in the Japanese Patent Laid Open 63-26399. However, in the prior art, the workpiece is moved in the vertical upward direction, in the horizontal direction, and then in the vertical downward direction, which makes the construction of the electroplating apparatus complicated. Consequently, a high installation cost and troublesome maintenance of the apparatus are imposed. Furthermore, the complicated structure of the apparatus makes it difficult to build a reliable sealing construction.

SUMMARY OF THE INVENTION

An object of the present invention is to provide an aluminum electroplating apparatus which is simple in construction.

To this end, the apparatus is arranged such that the workpiece is carried only in the horizontal direction in the apparatus.

Another object of the present invention is to provide an aluminum electroplating apparatus having a hermetically sealed entrance chamber for introducing a workpiece to a plating chamber. The entrance chamber has a protecting device for preventing a periphery of an opening of the chamber from corroding with corrosive agents.

A further object of the present invention is to provide a device which may supply an anode in a plating chamber without allowing air to enter into the plating chamber.

According to the present invention, there is provided an aluminum electroplating apparatus comprising first wall means defining a plating chamber, second wall means defining an entrance chamber provided adjacent the plating chamber at a substantially same level as the plating chamber, said first wall means having a first opening for communicating both the chambers with each other, a jig for hanging a workpiece, a carrier for supporting the jig, first conveying means for conveying the carrier between the entrance chamber and the plating chamber, at least one plating tank provided in the plating chamber, second conveying means provided in the plating chamber for conveying the jig between the carrier and the plating tank, an anode provided in the plating tank, and anode and cathode circuit means for causing a current to flow between the anode and the jig.

In an aspect of the invention, the first conveying means comprises rails provided on floors of the entrance chamber and the plating chamber and a hydraulic cylinder for moving the carrier along the rails, and the second conveying means comprises a trolley traveling on rails attached to the wall means at an upper portion of the plating chamber, an elevator guide downwardly extending from the trolley, an elevator provided to be elevated along the elevator guide, a hook provided on the elevator for elevating the jig, and a motor for driving the elevator.

The motor is provided in a sealed box, and gas pressure in the sealed box is kept at a higher pressure than the plating chamber.

In another aspect of the invention, the entrance chamber has a second opening at a top thereof, and a lid for closing the opening, and a device for opening the lid is provided. A sealing wall is secured to the carrier such that the sealing wall closes the first opening when the carrier is in the entrance chamber. A protector plate is provided for covering a part of a periphery of the second opening when said lid is opened.

These and other objects and features of this invention will become understood from the following description with reference to the accompanying drawings.

DETAILED DESCRIPTION OF THE PREFERRED EMBODIMENTS

Figure 1:
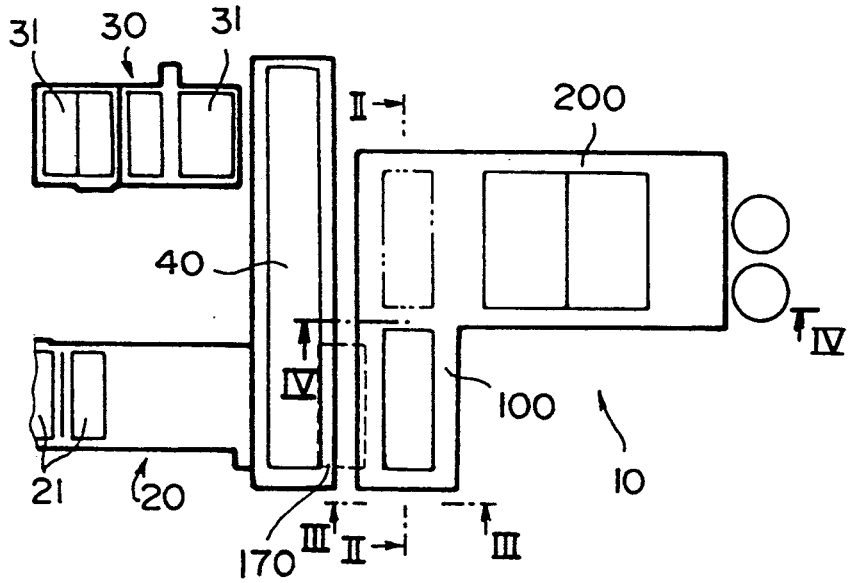
FIG. 1 is a plan view showing an aluminum electroplating apparatus according to the present invention and other apparatus cooperating the electroplating apparatus.

Referring to FIGS. 1 to 4, the aluminum electroplating apparatus of the present invention has an entrance chamber 100 and a plating chamber 200 which are horizontally arranged in the lateral direction and defined by walls 130 and 150. A floor 101 of the entrance chamber 100 is higher than a floor 201 of the plating chamber 200. A carrier 300 is adapted to travel between the chambers 100 and 200 with wheels 301 and 302 on rails mounted on the floors 101 and 201. The carrier 300 has a frame comprising a base 320 and pillars 321 at the four corners thereof. Provided on the frame is a pair of saddles 322 on which a frame 351 of a carrier jig 350 is ridden. A sealing wall 310 is secured to pillars 321 of the carrier 300 through brackets 311 and connected to a rod 401 of a hydraulic cylinder 400 through springs 403 attached to a pusher plate 402 which is secured to the end of the rod 401. The sealing wall 310 is located in the plating chamber 200 and pressed against the periphery of an opening formed in the wall 150 through an O ring 131*a* by springs 403, thereby hermetically separating the entrance chamber 100 from the plating chamber 200.

Figure 2:
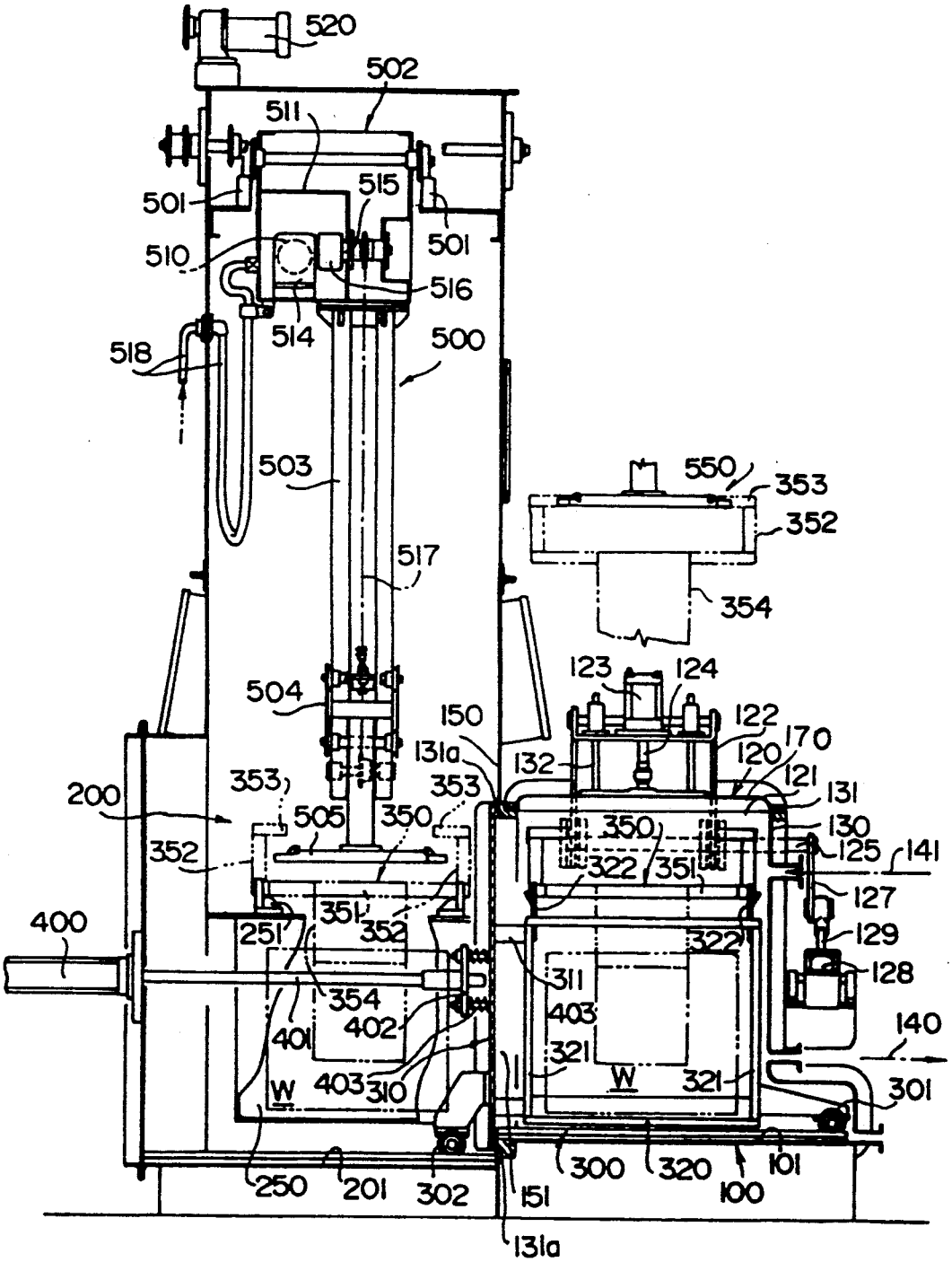
FIG. 2 is a sectional view taken along a line II—II of FIG. 1 which shows a front of the electroplating apparatus.

When the rod 401 is retracted, the sealing wall 310 is moved to the left in FIG. 2 together with the carrier 300 and the jig 350.

The jig 350 has hanger studs 352 at the four corners and hooks 353 inwardly projected from the studs, respectively. On the underside of the frame 351 of the jig 350 is secured holders 354, each holding a workpiece W.

Figure 3:
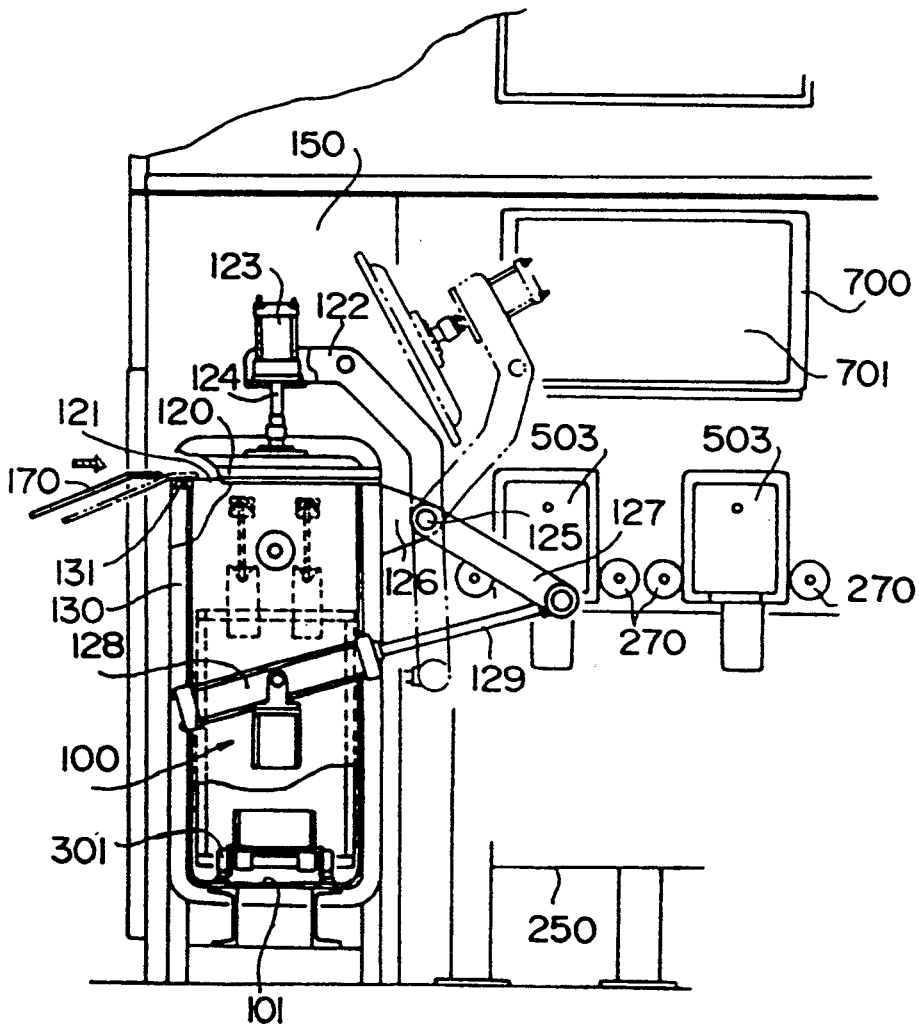
FIG. 3 is a sectional view taken along a line III—III of FIG. 1.

The entrance chamber 100 has an opening 121 at the top thereof which is closed by a lid 120. The lid 120 is held by a hydraulic cylinder 123 through a rod 124. As shown in FIG. 3, the cylinder 123 is securely mounted on an arm 122 which is connected to a rod 129 of a hydraulic cylinder 128 through a lever 127. The lever 127 is pivotally mounted on a bracket 126 through a shaft 125. Guide bars 132 are vertically provided for guiding the lid 120. An 0 ring 131 is provided on the periphery of the opening 121 for hermetically sealing the chamber.

A protector plate 170 is provided for protecting a peripheral portion of the opening 121 at the opposite side to the hinge of the lid from being contaminated with the electrolyte solution dropping from the plated workpiece when discharging from the entrance chamber. The protector plate 170 is operatively connected to a motor (not shown) to be retracted from the periphery of the opening when the lid is closed as shown in FIG. 3.

To open the lid 120, the rod 124 is retracted to raise the lid. Thereafter, the rod 129 of the cylinder 128 is also retracted, so that the arm 122 is pivoted in the clockwise direction as shown by the dot-dash lines in FIG. 3. The rising motion of the lid 120 is detected by an appropriate means such as a limit switch, and the motor is operated to project the protector plate 170, thereby covering the peripheral portion of the opening as shown by the dot-dash line in FIG. 3. Thus, the peripheral portion is prevented from corroding with the electrolyte solution, so that the hermetical sealing is ensured for a long term.

Figure 5A:
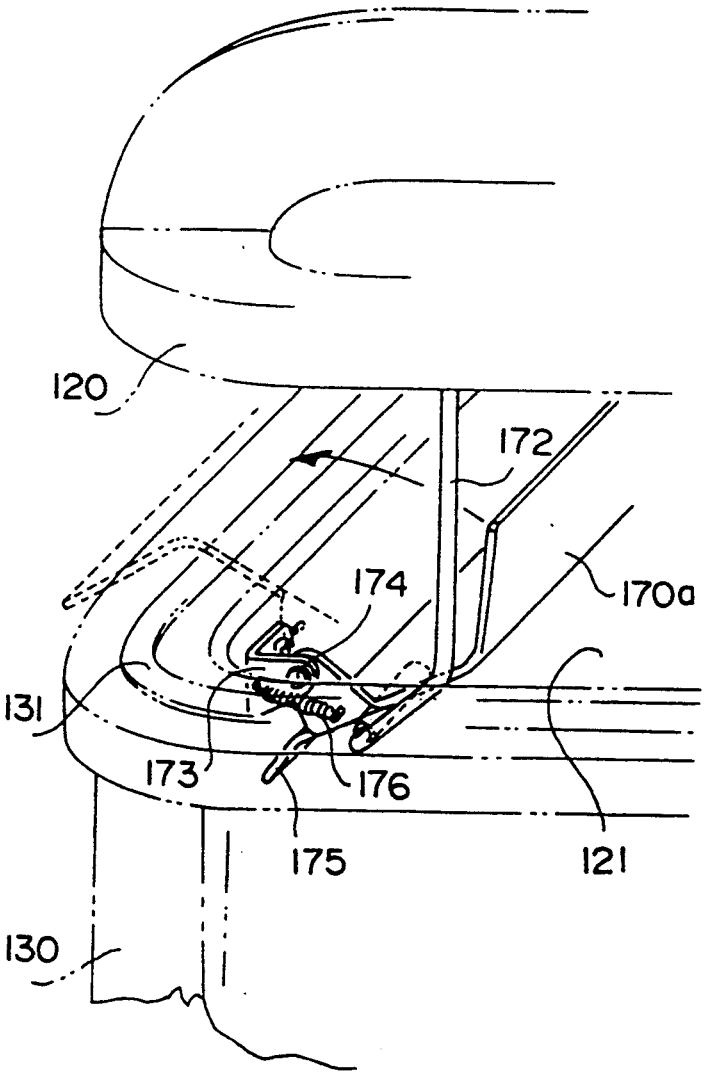
FIGS. 5*a* to 5*c* show an upper portion of an entrance chamber, respectively.
Figure 5B:
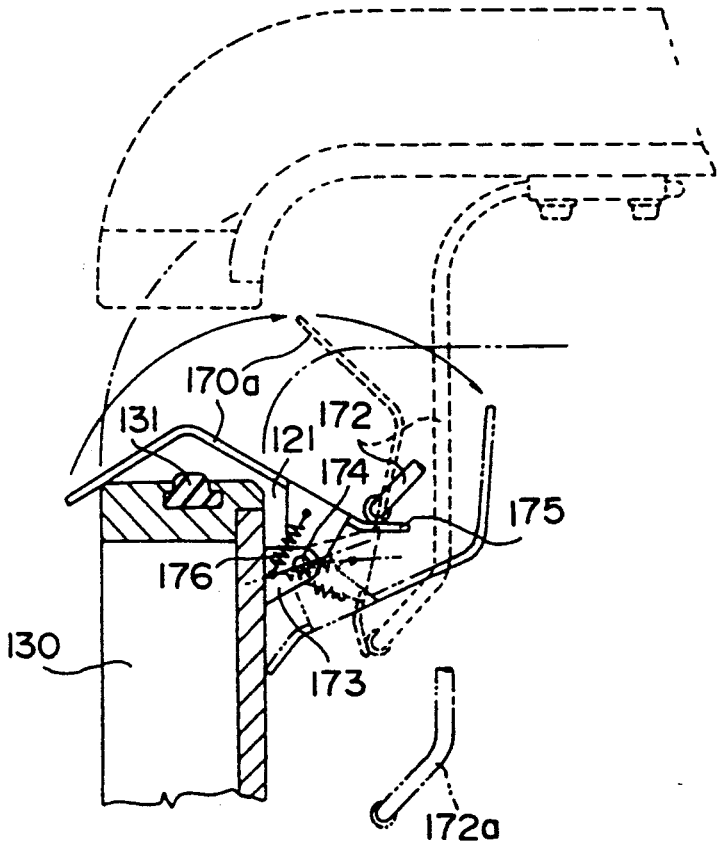
Figure 5C:
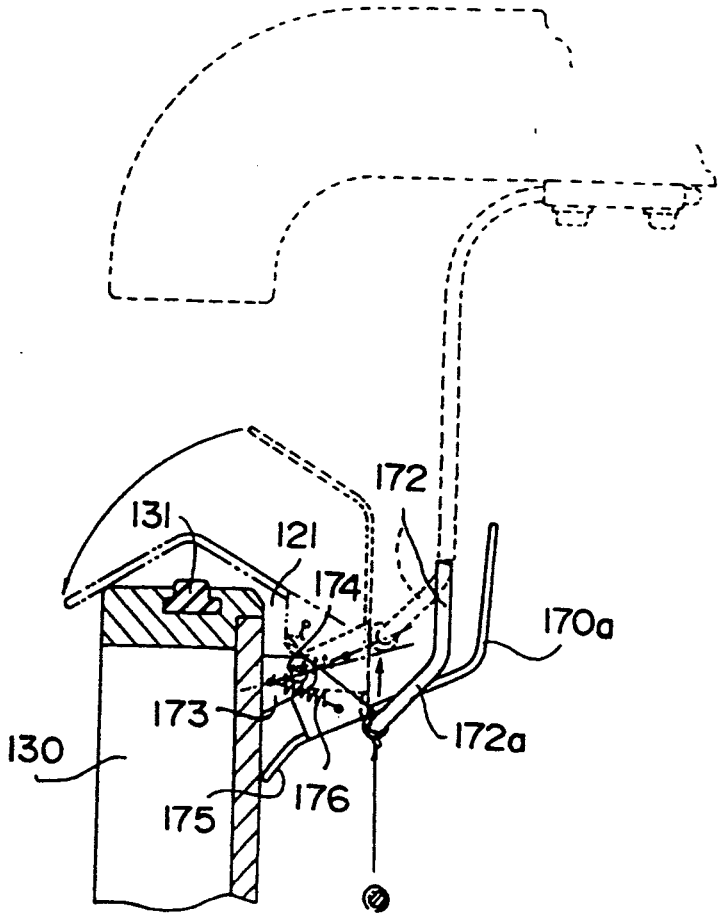

FIG. 5*a* to 5*c* show another example of the protector device. A protector plate 170*a* is pivotally mounted on a shaft 174 supported on a bracket 173. The protector plate 170*a* has a finger 175 on the opposite side to front edge of the protector plate. An actuating bar 172 is attached to the underside of the lid 120 so as to engage with the finger 175 when closing and to engage with the back side of the protector plate at an L-shaped end portion when opening A coil spring 176 is provided between the bracket 173 and the protector plate 170*a*. The spring 176 is so arranged as to urge the protector plate 170*a* to a shielding position (FIG. 5*b*) when the protector plate passes a neutral position towards the shielding position and to urge to an open position (FIG. 5*c*) when passes over the neutral position from the shielding position.

Thus, when the lid 120 is lowered, the bar 172 pushes the finger 175, so that the protector plate 170*a* is pivoted to the open position. To the contrary, the lid 120 is raised, the L-shaped end portion of the bar 172 engages with the back side of the plate 170*a* to move it to the shielding position.

Referring to FIG. 2, a conveying device 550 is provided above the entrance chamber 100 for charging and discharging and for conveying the workpiece W held by the jig 350. The conveying device 550 has hooks at opposite ends, which engage with hooks 353 of the jig so that the jig is elevated as shown by dot-dash lines in FIG. 2.

A discharge pipe 140 and an inert gas supply pipe 141 are connected to the wall 130 so as to be communicated with the entrance chamber 100. The discharge pipe 140 is connected to a vacuum pump (not shown) for discharging air in the entrance chamber when the lid 120 is closed. The pipe 141 is connected to an inert gas source. Thus, the entrance chamber can be filled with an inert gas such as nitrogen gas by supplying the inert gas after the discharge of air.

Figure 4:
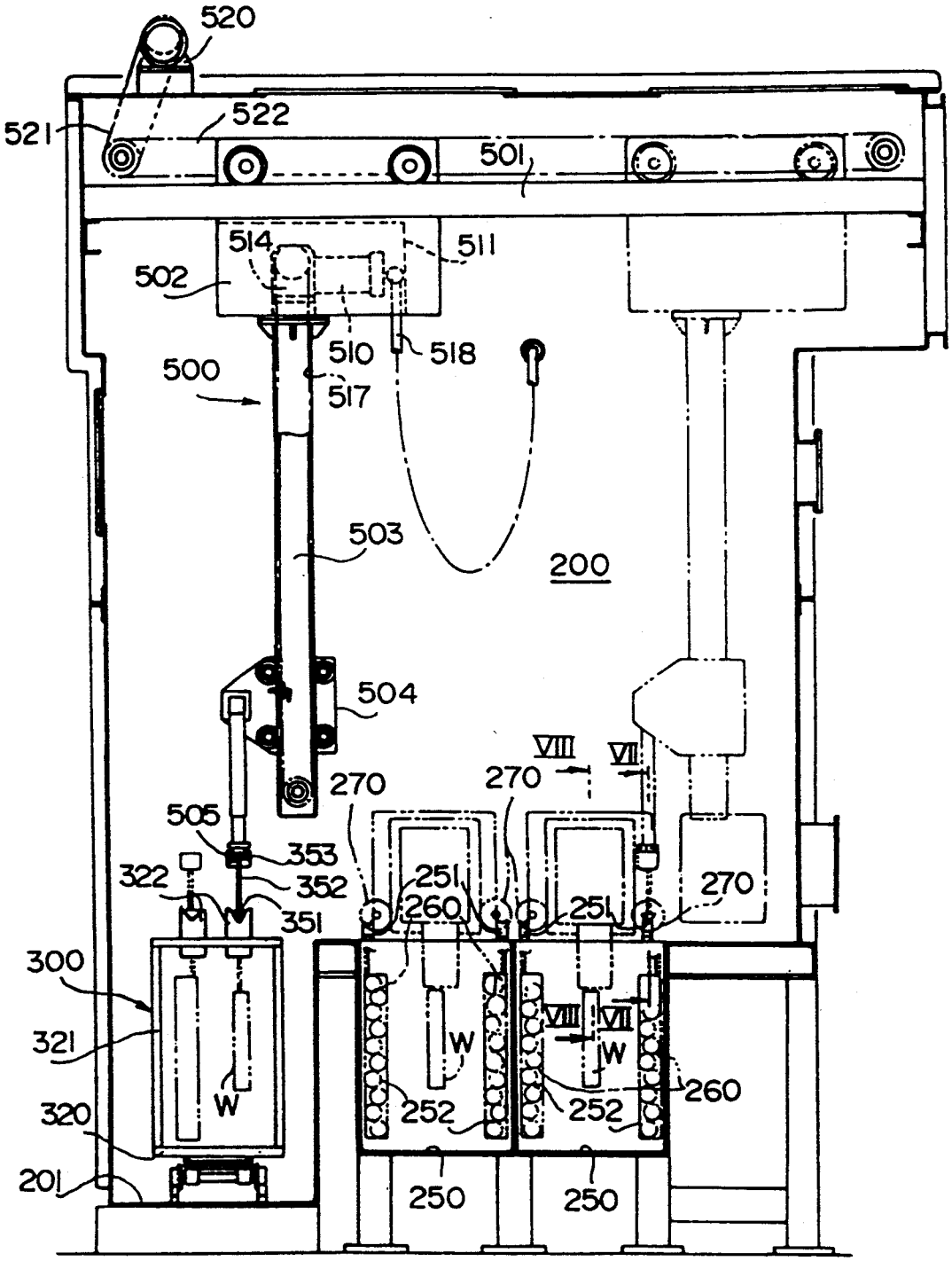
FIG. 4 is a sectional view taken along a line IV—IV of FIG. 1.

Referring to FIGS. 2 and 4, a conveying device 500 is provided in the plating chamber 200. The conveying device 500 comprises a trolley 502 traveling on a pair of rails 501 in the longitudinal direction, an elevator guide 503 downwardly extending from the trolley 502, and an elevator 504 slidably mounted on the guide 503. The elevator 504 has a hook 505 which is to be engaged with the hooks 353 of the jig 350.

Figure 6:
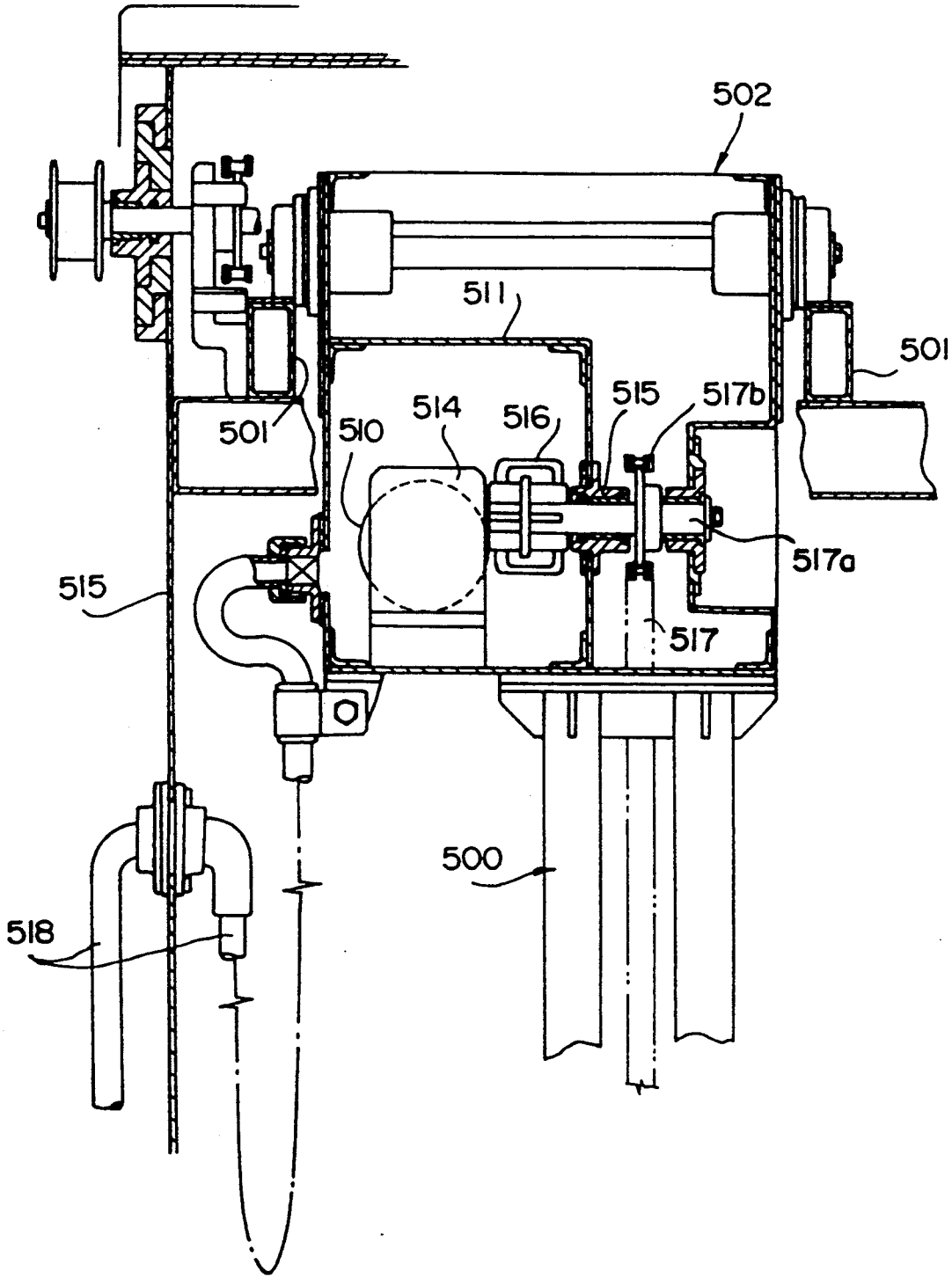
FIG. 6 is an enlarged sectional view of a part of FIG. 4.

A motor 510 for elevating the elevator 504 is provided in a sealed box 511 mounted on the trolley 502. A rotating shaft of the motor 510 is connected to a reduction gear device 514 which in turn connected to an outside shaft 517*a* through a coupling 516 as shown in FIG. 6. The shaft 517*a* is sealed by a collar device 515. The elevator 504 is hung from the shaft 517*a* through sprocket wheels 517*b* and a chain 517.

A gas pipe 518 is connected to the box 511 for supplying an inert gas into the box. The gas pressure in the box is set to a higher value than the plating chamber 200. For example, the atmospheric pressure in the plating chamber is kept at 4 torr and the atmospheric pressure in the box 511 is kept at 10 torr. Thus, the motor 510, reduction gear device 514 and others are protected from the corrosive atmosphere in the plating chamber, which includes vapor and mist of the electrolyte solution.

A motor 520 is installed on the ceiling of the chamber 200 for the traveling of the trolley 502. The rotating shaft of the motor 520 is connected to the trolley 502 through a reduction gear device and chains 521 and 522 so as to drive the trolley.

The conveying device 550 is similar to the conveying device 500 in construction.

Figure 11:
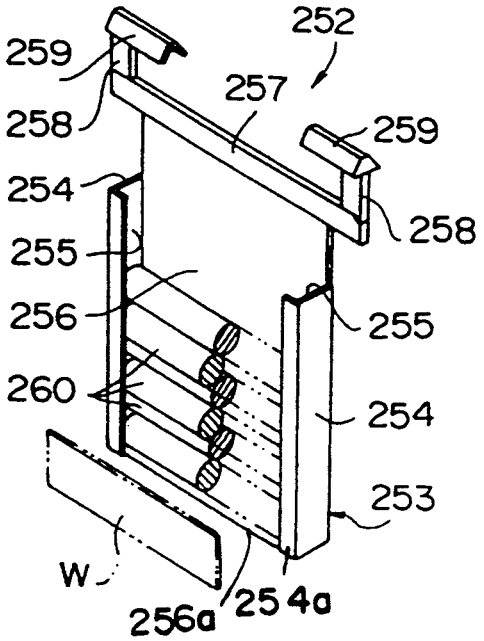
FIG. 11 is a perspective view showing an anode holder.

Referring to FIG. 4, two plating tanks 250 are installed, disposed in the longitudinal direction. A pair of saddles 251 are provided on the top of each plating tank for holding the jig 250. In the plating chamber 200 is provided in a pair of anode holders 252 adjacent the opposite sides of the workpiece W. As shown in FIG. 11, the anode holder 252 comprises a holding frame 253. The holding frame 253 comprises a pair of vertical side plates 254 each having an inner flange 254*a* forming a vertical groove 255, a back plate 256, and a bottom plate 256*a*. Thus, the top and front sides of the frame are opened. On the top of the back plate, a lateral plate 257 is secured. A pair of hooks 259 are securely mounted on the lateral plate 257 through connecting members 258, respectively.

Figure 7:
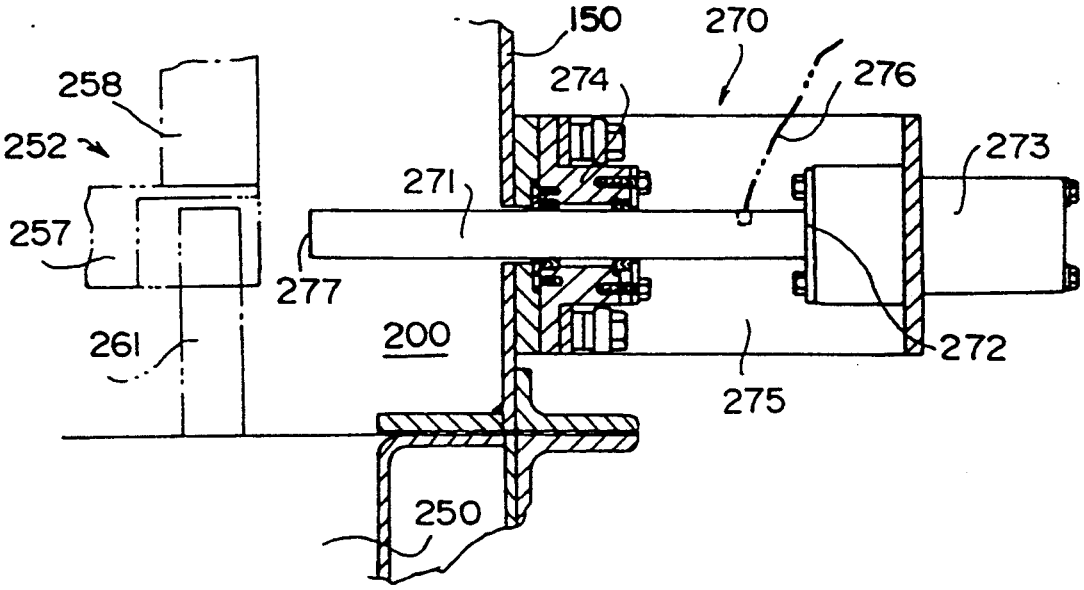
FIG. 7 is a sectional view taken along a line VII—VII of FIG. 4.

Referring to FIG. 7, a pair of saddles 261 are mounted on the top of the plating tank 250. The saddles 261 support the anode holder 252 at the lateral plate 257, while the anode holder 252 is immersed in the electrolyte solution.

An anode 260 in the form of a cylindrical bar is supplied in the groove 255 of the anode holder 252. The width of the groove 255 is slightly larger than the diameter of the anode. Consequently, anodes 260 supplied in the groove 255 are charged in a staggered arrangement, so that the anodes in contact with the back plate 256 are pressed against the back plate by weights of upper anodes. Thus, electric contact between the back plate 256 and the anodes is ensured.

Figure 10:
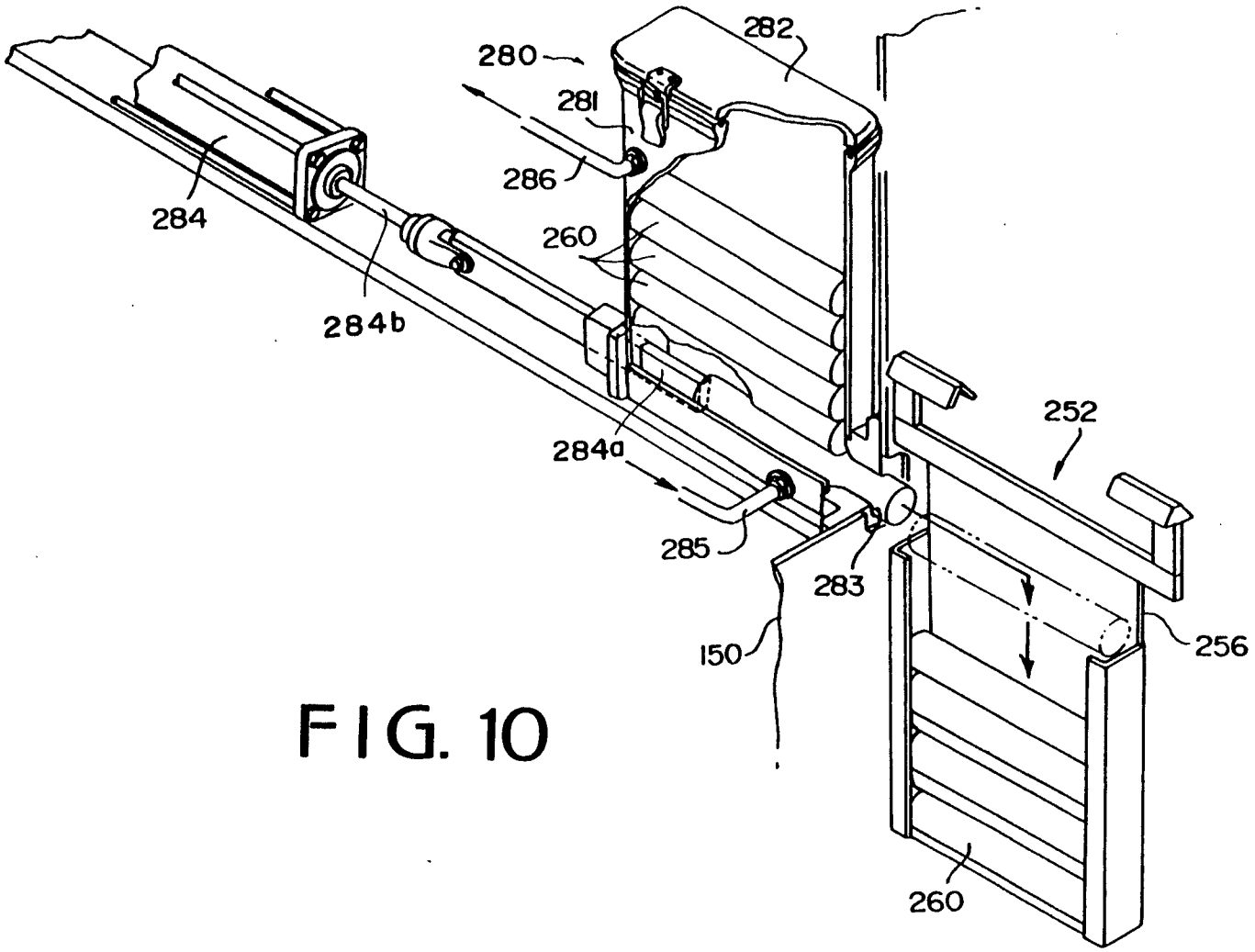
FIG. 10 is a perspective view showing an anode supply device.

The anode 260 is supplied by an anode supply device 280 shown in FIG. 10. The anode supply device 80 has a casing 281 secured to the wall 150 of the plating chamber, in which a plurality of anodes 260 are vertically charged. A lid 282 is detachably attached on the top of the casing 281 through a sealing means so as to hermetically seal the casing. A supply pipe 283 is secured to the casing at a lower portion thereof adjacent to one of the ends of the lowermost anode so as to form a supply port. The supply pipe 283 has a diameter slightly larger than that of the anode and the end portion thereof is projected into the plating chamber 200 passing through the wall 150 at an upper portion them the uppermost anode in the anode holder 252. A pusher **284*a* is slidably mounted in the casing 281 adjacent the other end of the lowermost anode. The pusher 284*a* is connected to a rod 284*b* of a hydraulic cylinder 284**.

When the rod **284*b* is projected, the pusher 284*a* pushes the lowermost anode in the casing 281 to feed it in the anode holder 252** from the top opening thereof.

An inert gas supply pipe 285 is connected to the casing 281 at a lower portion thereof, and a discharge pipe 286 is also connected to the casing at an upper portion thereof, so that the chamber in the casing is kept in an inert atmosphere state. Therefore, if the casing 281 is communicated with the plating chamber 200, air does not enter into the chamber 200 from the casing.

Electroplating current is supplied to the anodes 260 through the lateral plate 257 and the back plate 256 of the anode holder 252. When the anodes are consumed with the plating, a new anode is replenished by the anode supply device 280.

Referring to FIG. 7, an anode circuit device 270 is attached to the wall 150 of the plating chamber 200 adjacent the anode holder 252. The anode circuit device 270 has an anode busbar 271 slidably mounted in the wall 150, extending into the chamber 200. The outer end of the busbar 271 is connected through a flange 272 to a rod of a hydraulic cylinder 273 which is supported on the wall 150 by a bracket 257.

A sealing device 274 is secured to the wall 150 for airtightly holding the busbar 271. A cable 276 is connected to the busbar for supplying anode current. The busbar 271 is projected by the cylinder 273 to press an end face 277 against the lateral plate 257, thereby electrically connecting the busbar to the anode holder 252. On the end face 277, a plurality of fine grooves are formed in the form of matrix, so that the contact resistance between the lateral plate 257 and the end face 277 is reduced.

Figure 8:
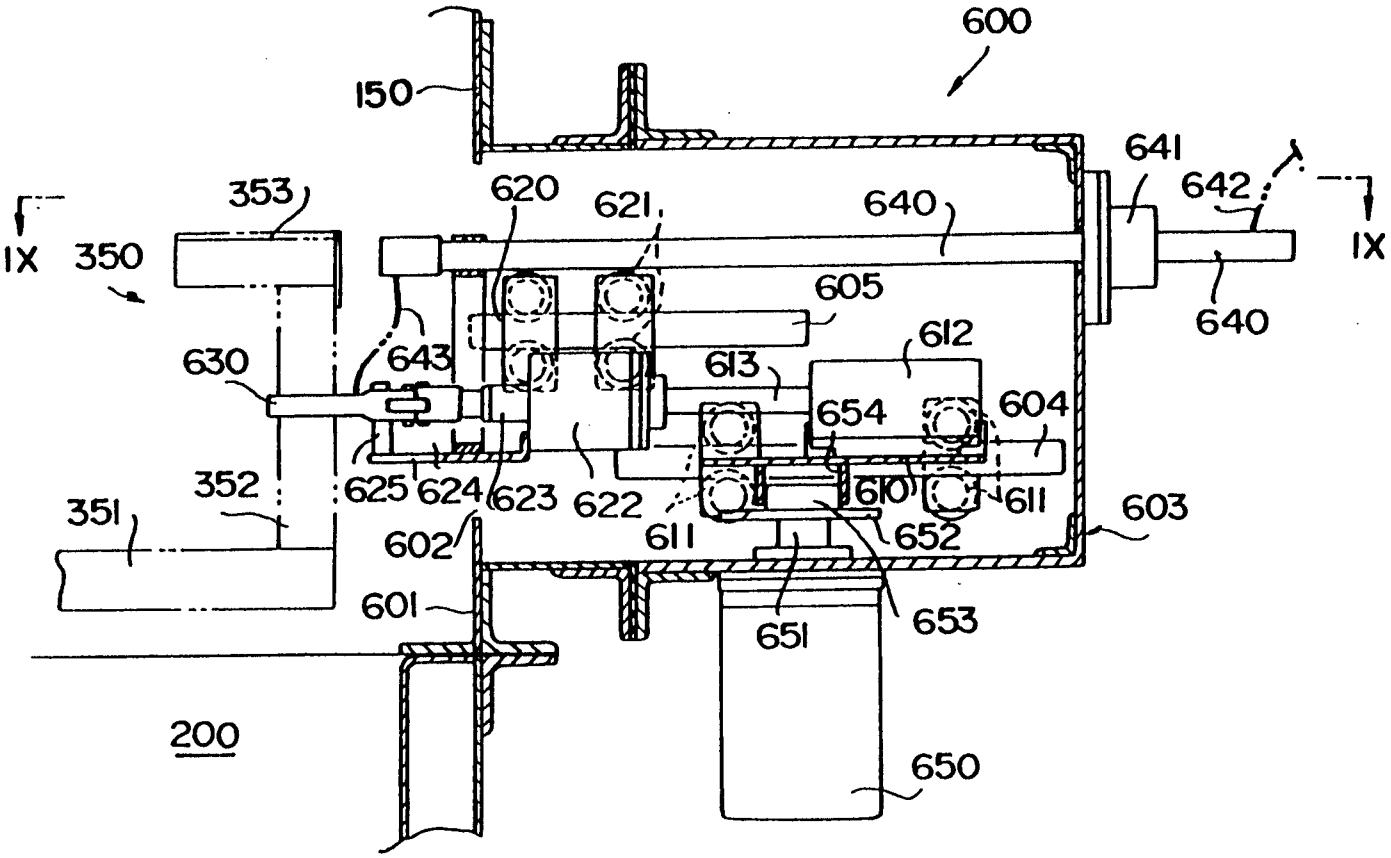
FIG. 8 is a sectional view taken along a line VIII—VIII of FIG. 4.
Figure 9:
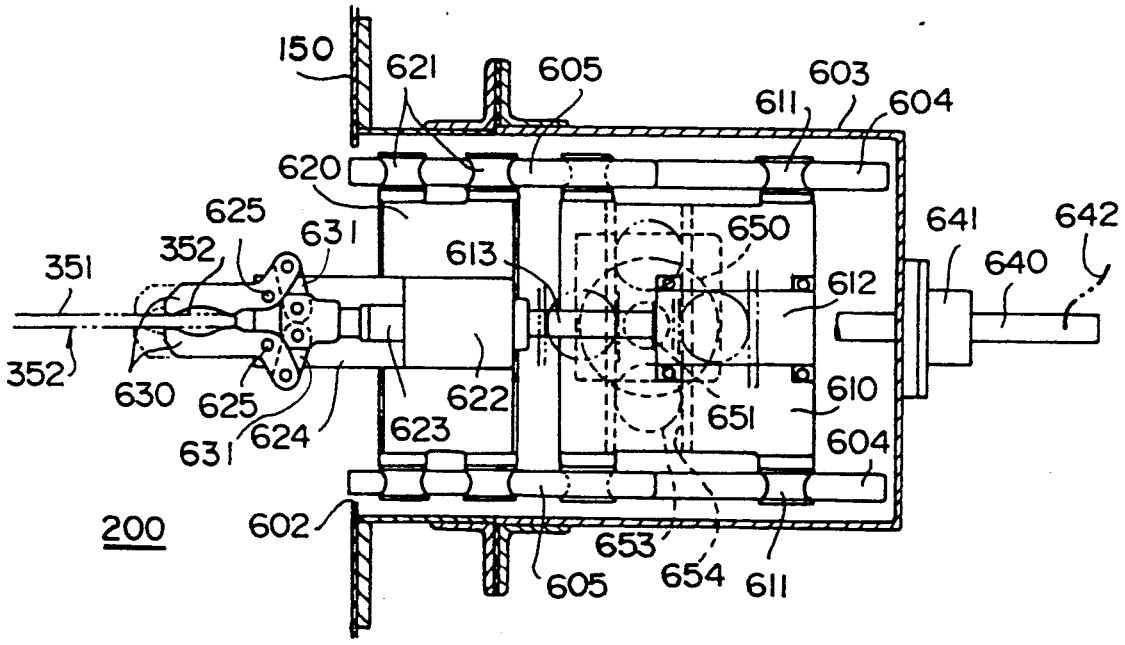
FIG. 9 is a sectional view taken along a line IX—IX of FIG. 8.

Referring to FIGS. 8 and 9, a cathode circuit device 600 is provided on the outside of the wall 150 adjacent the jig 350 placed on each plating tank 250. A casing 603 is attached to a periphery of an opening 602 formed in the wall 150. The chamber in the casing is airtightly separated from the outside atmosphere.

A pair of upper rails 605 and a pair of lower rails 604 are provided in the casing 603.

A frame 610 has four pairs of rollers 611, each pair of which grips the lower rail 604, thereby supporting the frame so as to be traveled along the rails 604. On the underside of the frame 610, a pair of lateral plates 654 is secured to form a lateral guide groove. An eccentric roller 653 rotatably mounted on a rotating plate 652 is rotatably engaged with the guide groove. The roller 653 is eccentric with respect to the center of the rotating plate 652. The rotating plate 652 is fixed to a shaft 651 of a motor 650 secured to the underside of the casing 603.

Therefore, when the rotating plate 652 is rotated by motor 650, the frame 610 is reciprocated along the rails 604.

On the upper rails 605, a frame 620 is movably mounted by a plurality of rollers 621. Mounted on the underside of the frame 620 is a hydraulic cylinder 622 which is connected to a rod of a cylinder 612 securely mounted on the frame 610. Thus, the frame 620 is reciprocated with the frame 610. A rod of the cylinder 622 is connected to a pair of jaws 630 of a chuck through levers 631. Each jaw 630 is pivotally mounted on a shaft 625 fixed on a bracket 624 which is secured to the cylinder 622. The jaws 630 are adapted to grip the hanger stud 352 of the jig 350.

A cathode busbar 640 is slidably and hermetically mounted in the wall of the casing 603 by a sealing device 641, and connected to the bracket 624. The busbar 640 is connected to a cathode source (not shown) by a cable 642, and to the jaw 630 by a cable 643. Thus, a cathode circuit is provided.

In order to improve the quality of the finished workpiece W, a pretreating line 20 and an after treatment line 30 are provided as shown in FIG. 1. The pretreating line 20 has a plurality of tanks 21 for degreasing, washing, acid pickling, and others. The after treating line 30 is provided with a plurality of tanks for washing, chemical conversion and others. Furthermore, a conveyer 40 is provided for conveying workpieces in the lateral direction.

Although the pretreating line 20 and the after treating line 30 are parallely disposed, it is possible to disposed the pretreating line, the after treating line and the plating chamber in series. In such a case, it is preferable to provide the entrance chamber 100 at an inlet of the plating chamber 200 and to install a discharge chamber at an outlet of the plating chamber.

In operation, the workpiece W to be coated is hung from the jig 350 and conveyed on the pretreating line 20 by the conveying device 550 where the workpiece is in the tanks 21. The treated workpiece W is inserted in the entrance chamber 100 from the opening 121. The frame 351 of the jig 350 is ridden on the saddle 322 and the lid 120 is closed to seal the entrance chamber 100. Air in the entrance chamber 100 is sucked through the discharge pipe 140 and inert gas is supplied through the supply pipe 141, thereby filling the entrance chamber with the inert gas. At that time, the carrier 300 is located in the entrance chamber, so that the sealing wall 310 is pressed against the wall 150 to close the opening. Thus, the air in the entrance chamber 100 does not enter into the plating chamber 200 when the lid 120 is opened.

When the entrance chamber 100 becomes a predetermined inert atmosphere, the hydraulic cylinder 400 operates to retract the rod 401 to move the carrier 300 to the plating chamber 200.

In the plating chamber 200, the jig 350 is elevated by the conveying device 500 together with the workpiece W, and the workpiece is immersed in the electrolyte solution in one of the plating tanks 250. Thereafter, the busbar 271 of the anode circuit device 270 is contacted with the anode holder 252, and the jaws 630 of the cathode circuit device 600 grip the hanger stud 352 of the jig 350. Thus, plating current flows between the anode 260 and the workpiece W in the plating tank 250 to coat the workpiece with aluminum.

The electrolyte solution is, for example, non-aqueous solvent including halogenated aluminum, ammonium salt, and others. The electrolyte solution is liable to be deteriorated by oxygen and water. However, since the plating chamber 200 is hermetically separated from the atmosphere as described above, the electrolyte solution is kept in an initial condition. Consequently, articles having uniform quality can be produced under a constant condition.

The coated workpiece W is elevated from the plating tank 250 in the reverse order to the insertion, put on the carrier, and conveyed to the entrance chamber 100. The lid 120 is opened, and then the workpiece is discharged from the entrance chamber 100 by the conveying device 550 and conveyed to the after treating line 30. At the after treating line 30, the workpiece W is finished by washing, drying, and others.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An aluminum electroplating apparatus comprising:

first wall means defining a plating chamber;

second wall means defining an entrance chamber provided adjacent the plating chamber at a substantially same level as the plating chamber;

said first wall means having a first opening for communicating both the chambers with each other;

a jig for hanging a workpiece;

a carrier for supporting the jig;

first conveying means for conveying the carrier between the entrance chamber and the plating chamber;

at least one plating tank provided in the plating chamber;

second conveying means provided in the plating chamber for conveying the jig between the carrier and the plating tank;

an anode provided in the plating tank; and anode and cathode circuit means for causing a current to flow between the anode and the jig.

2. The apparatus according to claim 1 wherein said first conveying means comprises rails provided on floors of the entrance chamber and the plating chamber and a hydraulic cylinder for moving the carrier along the rails.

3. The apparatus according to claim 1 wherein said second conveying means comprises a trolley traveling on rails attached to the wall means at an upper portion of the plating chamber, an elevator guide downwardly extending from the trolley, an elevator provided to be elevated along the elevator guide, a hook provided on the elevator for elevating the jig, and a motor for driving the elevator.

4. The apparatus according to claim 3 wherein said motor is provided in a sealed box, and gas pressure in the sealed box is kept at a higher pressure than the plating chamber.

5. The apparatus according to claim 1 wherein said entrance chamber has a second opening at a top thereof, and a lid for closing the opening, and the apparatus further comprising a device for opening the lid.

6. The apparatus according to claim 1 further comprising a sealing wall secured to the carrier such that the sealing wall closes the first opening when the carrier is in the entrance chamber.

7. The apparatus according to claim 5 further comprising a protector plate provided for covering at least a part of a periphery of said second opening when said lid is opened.

8. The apparatus according to claim 7 wherein said protector plate is operatively connected to the lid so as to be moved in accordance with the movement of the lid.

9. An aluminum electroplating apparatus comprising;

first wall means defining a plating chamber;

second wall means defining an entrance chamber provided adjacent the plating chamber at a substantially same level as the plating chamber;

conveying means for conveying a workpiece between the entrance chamber and the plating chamber;

at least one plating tank provided in the plating chamber;

a plurality of cylindrical anodes vertically stacked in a anode holder provided in the plating tank;

anode and cathode circuit means for causing a current to flow between the anode holder and the workpiece, a casing provided outside the plating chamber, in which a plurality of stock anodes are vertically charged;

a supply pipe secured to the casing at a lower portion thereof adjacent to one of the ends of the lowermost stock anode so as to form a supply port, and opened to the plating chamber at an upper portions than the uppermost anode in the anode holder 252;

a pusher slidably mounted in the casing adjacent the other end of the lowermost anode; and a hydraulic cylinder for moving the pusher for a plurality of cylindrical anodes vertically stacked in a anode holder provided in the plating tank;

10. The apparatus according to claim 9 wherein the casing is filled with an inert gas.

11. The apparatus according to claim 10 wherein said anode holder comprises a pair of vertical side plates each having an inner flange forming a vertical groove, a back plate, and a bottom plate so that the top and front sides of the anode holder are opened, the vertical groove has a width slightly larger than the diameter of the anode so as to stack the anode in a staggered arrangement.

* * * * *

UNITED STATES PATENT AND TRADEMARK OFFICE

CERTIFICATE OF CORRECTION

PATENT NO. : 5,141,615

DATED : August 25, 1992

INVENTOR(S) : SAEKI et al

It is certified that error appears in the above-identified patent and that said Letters Patent is hereby corrected as shown below:

ON THE TITLE PAGE:

Change "ASAKAWA KIYOSHI" to --KIYOSHI ASAKAWA--.

Change "YUTAKE SUGIURA" to --YUTAKA SUGIURA--.

Signed and Sealed this

Twelfth Day of October, 1993

*Attest:*

*Attesting Officer*

BRUCE LEHMAN

*Commissioner of Patents and Trademarks*